United States Patent [19]

Eheim

[11] 4,445,476

[45] May 1, 1984

[54] RPM GOVERNOR OF A FUEL INJECTION PUMP

[75] Inventor: Franz Eheim, Stuttgart, Fed. Rep. of Germany

[73] Assignee: Robert Bosch GmbH, Stuttgart, Fed. Rep. of Germany

[21] Appl. No.: 379,405

[22] Filed: May 18, 1982

[30] Foreign Application Priority Data

May 27, 1981 [DE] Fed. Rep. of Germany ..... 3121107

[51] Int. Cl.[3] ..... F02D 1/06

[52] U.S. Cl. ..... 123/387; 123/367; 417/282; 417/289

[58] Field of Search ..... 123/387, 385, 386, 388, 123/367, 507; 417/282, 289, 294

[56] References Cited

U.S. PATENT DOCUMENTS

| | | | |
|---|---|---|---|
| 2,708,921 | 5/1955 | Links | 123/367 |
| 3,635,603 | 1/1972 | Eheim | 417/282 |
| 3,946,716 | 3/1976 | Konrath | 123/387 |
| 4,278,058 | 7/1981 | Berner | 123/387 |
| 4,308,834 | 1/1982 | Eheim | 123/387 |

FOREIGN PATENT DOCUMENTS

| | | | |
|---|---|---|---|
| 1911913 | 9/1970 | Fed. Rep. of Germany | 123/387 |
| 54-10830 | 1/1979 | Japan | 123/386 |
| 1375841 | 11/1974 | United Kingdom | 123/388 |
| 2063513A | 6/1981 | United Kingdom | 123/387 |

*Primary Examiner*—Ira S. Lazarus
*Assistant Examiner*—Magdalen Moy
*Attorney, Agent, or Firm*—Edwin E. Greigg

[57] ABSTRACT

The invention relates to an rpm governor of a fuel injection pump for internal combustion engines, in which a positive or negative adaptation is attainable by way of a hydraulically actuated piston. The fluid pressure determining the piston position is variable by means of a valve in an outflow conduit from the control pressure chamber.

5 Claims, 1 Drawing Figure

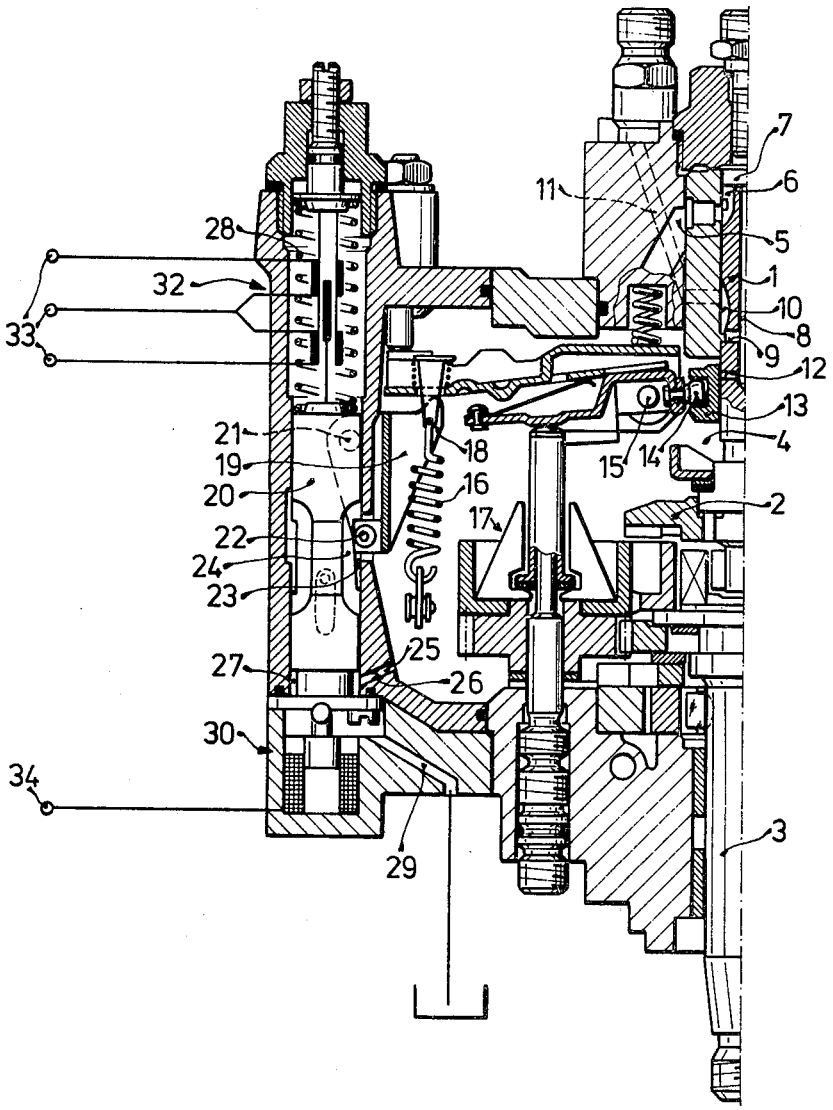
7
6
11
5
28
1
32
10
33
8
9
12
13
21
18
4
19
15
14
16
20
2
17
22
24
23
25
27
26
30
34
3
29

RPM GOVERNOR OF A FUEL INJECTION PUMP

BACKGROUND OF THE INVENTION

The invention relates to an rpm governor of a fuel injection pump for internal combustion engines, which includes an adjustable stop for limiting the maximum injection quantity, a piston which is hydraulically displaceable counter to a restoring force to vary the position of the stop, and pressure control apparatus for controlling the pressure exerted on one end of the piston within a work chamber to determine the position of the piston and stop.

In a known governor of this type, the piston is exposed to fuel from the suction chamber of the fuel injection pump, the pressure of which varies in accordance with engine rpm. The piston is thus displaced in one direction as the rpm increases, and in the opposite direction with decreasing rpm. The adaptation course itself is determined by a curve in the jacket face of the piston, which is scanned and which must have a different course for each engine or for each additional further engine characteristic taken into account. Any pressure fluctuations in the suction chamber of the injection pump at the same time cause a change in adaptations, that is, in the piston position, which is expressed in a correspondingly poorer operation or in changed exhaust gas figures for the engine.

OBJECT AND SUMMARY OF THE INVENTION

In the present invention, an rpm governor of the known type described above includes a throttle, which is disposed in an inflow conduit connecting the work chamber with a source of pressurized fluid, to allow fluid from the fluid source to be supplied to the work chamber while assuring that the work chamber pressure is uncoupled from the fluid source pressure. Also, the pressure control apparatus includes a valve which is disposed in a pressure relief or outflow conduit of the work chamber and which is arbitrarily actuated to control the work chamber pressure, and thus the position of the piston and the stop determining the maximum injection quantity.

The rpm governor according to the invention has the advantage over the prior art of general applicability to injection pumps for various types of engines, particularly those which operate with charge pressure (supercharged engines). By way of a simple curved contour on the piston and by means of the individual adjustability of the piston position, virtually every case of adaptation, regardless of whether it is a positive or a negative adaptation of the maximum fuel injection quantity, can be taken care of.

In a preferred embodiment of the invention, an electric travel path transducer is used to supply a piston position signal to an electronic control unit, in which various engine characteristics such as load and rpm are processed as actual values in comparison with appropriate set-point values for the purpose of adaptation, and the outlet conduit valve is a magnetic valve which is actuated by the electronic control unit to determine the maximum fuel injection quantity. In this preferred embodiment, using an electronic control unit, the injection quantity can be determined by the position of the piston in the manner of an electronic regulator, so that if needed an additional mechanical regulator is able to assume solely the function of a safety regulator. A safety regulator of this kind may be lighter, that is, it may be equipped with smaller flyweights. The valve determining the control pressure for the piston in the outflow conduit may be controllable either continuously or intermittently. In the case of an electronic control unit, when a magnetic valve is used, intermittent control of the magnetic valve for determining pressure is recommended. However, mechanical control of the outflow valve is also possible.

The invention will be better understood and further objects and advantages thereof will become more apparent from the ensuing detailed description of a preferred embodiment, taken in conjunction with the drawing.

BRIEF DESCRIPTION OF THE DRAWING

Serving as the exemplary embodiment of the subject of the invention is the rpm governor of a conventional distributor-type injection pump. The rpm governor and fuel injection pump are shown in longitudinal section, only half of the distributor-type pump being shown.

DESCRIPTION OF THE PREFERRED EMBODIMENT

The pump piston 1 of a fuel injection pump, which simultaneously reciprocates and rotates, is driven by a cam plate 2 as well as a drive shaft 3. Only the left half of the pump piston, cam plate and drive shaft is shown. During the intake stroke of the pump piston 1, fuel leaves a suction chamber 4 for the injection pump by way of a suction conduit 5 and suction groove 6 and passes into the pump work chamber 7. During the compression stroke of the pump piston 1, at least a portion of this fuel is positively displaced out of the pump work chamber 7 via a central axial bore 8, a radial bore 9 and a distributor groove 10, both of which are disposed in the pump piston 1, and via pressure conduits 11 and pressure lines to the engine, and the distributor groove 10 opens a different one of the pressure conduits 11 depending upon the rotary position of the pump piston 1. The number of pressure conduits 11 corresponds to the number of cylinders to the engine. Another portion of the fuel from the pump work chamber 7 passes via a radial diversion bore 12 of the pump 1 back into the suction chamber 4, as soon as this diversion bore 12 is opened by an annular control slide 13 after a predetermined stroke has been executed. This annular slide 13 thus by its axial position determines the injection quantity supplied to the engine.

The position of the annular slide 13 is determined by an rpm governor. This rpm governor comprises a lever system, which articulates the annular slide 13 via a head 14 and is supported on a shaft 15. In one direction, a regulator spring 16 and in the other direction a centrifugal adjuster 17 engage this lever system, both functioning as is known from many sources, so that a repetition of their description here is superfluous. However, a stop 18 additionally engages the lever system and determines the maximum fuel injection quantity. The stop 18 is disposed on a bell crank 19, which is pivotable, relative to the housing of a piston 20, about a bearing point 21. The position of the stop 18 is determined by the piston 20 and a roller bearing 22, which is disposed on the bell crank 19 in rolling contact with the piston 20. In the sole figure, the bearing point 21 is disposed either ahead of or behind the piston 20 and is therefore shown by dashed lines. The roller 22 passes over a contour 23 provided on a rib 24 of the piston 20 resulting from the flattening of the piston at this point. Upon the axial displacement of the piston 20, the bell crank 19 is thus tilted about its bearing point 21, and the position of the stop 18 and thus the maximum injection quantity of the fuel injection pump thereby vary.

The actuation of the piston 20 is effected hydraulically, in that pressure fluid passes through an inflow conduit 25 in which a throttle 26 is disposed and into a work chamber 27 ahead of one end face of the piston 20. In this exemplary embodiment, fuel from the suction chamber 4 of the injection pump serves as the pressure fluid, because here a practical pressure source is available, specifically fuel under servo pressure, which is conventionally used for actuating an injection time adjuster. As soon as sufficient fuel pressure prevails on the work chamber 27, the piston 20 is displaced counter to a restoring spring 28, causing a corresponding pivoting movement on the part of the bell crank 19. In order to be able to control this stroke movement arbitrarily, an outflow conduit 29 branches off from the work chamber 27, its passage being controllable by a magnetic valve 30. In this example, the magnetic valve 30 is switched such that when it is excited it opens the outflow conduit 29. When it is free of electrical current, the magnetic valve 30 is closed, so that the pump cannot run empty. During operation, the throttle 26 in the inflow conduit 25 prevents the pressure in the suction chamber 4 from being excessively reduced, even when the magnetic valve 30 is opened. The throttle 26 furthermore assures pressure uncoupling between the suction chamber 4 and the work chamber 27, so that with a magnetic valve 30 which is opened from time to time and in particular intermittently, the desired pressure between zero and the suction chamber pressure can be established in the work chamber 27. The higher the pressure in the work chamber 27, the more the piston 20 is displaced counter to the spring 28 and thus the smaller is the maximum injection quantity. In other words, the further the piston is displaced counter to the spring 28, given the selected course of the contour 23, the more the resultant adaptation is "positive". In the illustrated position, adaptation is at the maximum "negative" extent.

The stroke of the piston 20 is measured via an electric transducer 32, which is embodied by way of example in the sole figure as a moving coil transducer. Also, the transducer 32 may be a mehanicolectric converter similar to that described in U.S. Pat. No. 3,718,123, issued Feb. 27, 1973 to Eckert et al. The transducer 32 with its electrical terminals 33, like the magnetic valve 30 with its electrical terminal 34, is connected with an electric control unit (not shown) in which engine characteristics such as load and rpm are processed as actual values in comparison with appropriate set-point values for the purpose of adaptation.

Since the change in position of the stop 18 is simultaneously a change in the maximum fuel injection quantity, the illustrated system can also serve as an electrical rpm governor, in which case the mechanical rpm transducer then serves solely as a safety governor.

The foregoing relates to a preferred exemplary embodiment of the invention, it being understood that other embodiments and variants thereof as possible within the spirit and scope of the invention, the latter being defined by the appended claims.

What is claimed and desired to be secured by Letters Patent of the United States is:

1. In an rpm governor of a fuel injection pump for internal combustion engines, including a housing, an adjustable stop for limiting the maximum injection quantity (full load), a piston in said housing which is hydraulically displaceable counter to a restoring force for varying the position of the stop, said piston having only one end thereof which is exposed to fluid within a work chamber, an inflow conduit in said housing through which fluid from a fluid source flows into said work chamber and pressure control means for controlling the pressure of the fluid within the work chamber, the improvement including:

a throttle disposed in the inflow conduit for restricting fluid flow into said work chamber from said fluid source;

a fluid outflow conduit in said housing extending from said work chamber to a fluid return line for permitting fluid flow from said work chamber, said pressure control means for controlling the pressure in the work chamber is a magnetic valve which is disposed relative to said outflow conduit extending from said work chamber for controlling fluid flow from said work chamber in accordance with load and rpm of an engine to determine a full load injection quantity, and an electric travel path transducer which is connected with an electronic control unit for measuring the stroke of the piston.

2. An rpm governor as defined by claim 1, which further comprises:

a fuel suction chamber which is disposed in the housing of the injection pump and which communicates with the work chamber via the inflow conduit; and said fuel pressure control means provides an rpm-dependent pressure for fuel which is disposed within the fuel suction chamber and which constitutes said fluid source.

3. An rpm governor as defined by claim 1 in which said adjustable stop is a bell crank having a first end acting as the stop and a second end which follows the course of a curve disposed in a jacket face of said piston.

4. An rpm governor as defined by claim 3, wherein the first end of the bell crank cooperates with a quantity adjusting lever of the governor.

5. An rpm governor as claimed in claim 1 in which said magnetic valve is in axial alignment with said piston relative to said outflow conduit.

* * * * *